US010053119B2

(12) United States Patent
Nishimura et al.

(10) Patent No.: US 10,053,119 B2
(45) Date of Patent: Aug. 21, 2018

(54) PLATE SPRING COVER AND RAILCAR BOGIE INCLUDING PLATE SPRING COVER

(71) Applicant: KAWASAKI JUKOGYO KABUSHIKI KAISHA, Kobe-shi, Hyogo (JP)

(72) Inventors: Takehiro Nishimura, Kobe (JP); Shunichi Nakao, Kobe (JP); Yasufumi Okumura, Kobe (JP); Shintaro Ando, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 255 days.

(21) Appl. No.: 14/900,508

(22) PCT Filed: May 19, 2014

(86) PCT No.: PCT/JP2014/002622
§ 371 (c)(1),
(2) Date: Dec. 21, 2015

(87) PCT Pub. No.: WO2014/203450
PCT Pub. Date: Dec. 24, 2014

(65) Prior Publication Data

US 2016/0251023 A1 Sep. 1, 2016

(30) Foreign Application Priority Data

Jun. 19, 2013 (JP) ..... 2013-128781

(51) Int. Cl.
*B61F 5/30* (2006.01)
*B61F 5/52* (2006.01)
(Continued)

(52) U.S. Cl.
CPC ..... *B61F 5/304* (2013.01); *B61F 3/02* (2013.01); *B61F 5/302* (2013.01); *B61F 5/50* (2013.01); *B61F 5/52* (2013.01)

(58) Field of Classification Search
CPC ..... B61F 5/00; B61F 5/02; B61F 5/04; B61F 5/06; B61F 5/08; B61F 5/10; B61F 5/14; B61F 5/22
See application file for complete search history.

(56) References Cited

U.S. PATENT DOCUMENTS

2012/0279416 A1* 11/2012 Nishimura ..... B61C 9/50 105/218.1
2014/0137765 A1 5/2014 Nishimura et al.

FOREIGN PATENT DOCUMENTS

WO 2013/008468 A1 1/2013

OTHER PUBLICATIONS

Aug. 5, 2014 Search Report issued in International Patent Application No. PCT/JP2014/002622.
(Continued)

*Primary Examiner* — Robert J McCarry, Jr.
(74) *Attorney, Agent, or Firm* — Oliff PLC

(57) ABSTRACT

Bogie includes: cross beam supporting carbody of railcar; wheels provided at each of both car width direction sides of bogie to be lined up in car longitudinal direction; front and rear axles each connecting wheels positioned at respective left and right car width direction sides of bogie to each other; bearings provided at both respective car width direction sides of front and rear axles and rotatably supporting front and rear axles; axle boxes accommodating respective bearings; plate springs of fiber-reinforced resin and extending in car longitudinal direction support both respective car width direction end portions of cross beam, both car longitudinal direction end portions of plate springs supported by respective axle boxes; electrically nonconductive buffer members
(Continued)

each interposed between plate spring and axle box; electrically nonconductive contacting members each interposed between plate spring and cross beam; and plate spring cover covering part of plate spring and electrically connected to wheel.

5 Claims, 2 Drawing Sheets

(51) Int. Cl.
*B61F 3/02* (2006.01)
*B61F 5/50* (2006.01)

(56) References Cited

OTHER PUBLICATIONS

Dec. 22, 2015 International Preliminary Report on Patentability issued in International Patent Application No. PCT/JP2014/002622.

* cited by examiner

PLATE SPRING COVER AND RAILCAR BOGIE INCLUDING PLATE SPRING COVER

TECHNICAL FIELD

The present invention relates to a plate spring cover covering a plate spring in a railcar bogie, the plate spring being made of fiber-reinforced resin, and the railcar bogie including the plate spring cover.

BACKGROUND ART

A railcar bogie which supports a carbody by a plate spring made of fiber-reinforced resin instead of a conventional side sill made of a steel material has been developed (see PTL 1). This bogie is simple and lightweight, and assembling workability of the bogie is excellent.

CITATION LIST

Patent Literature

PTL 1: WO 2013/008468 A1

SUMMARY OF INVENTION

Technical Problem

In a case where electric power for driving an electrical apparatus in a railcar is supplied through an overhead contact line, a current flows through the electrical apparatus to rails. If a large potential difference is generated between the carbody and the bogie in such a railcar for some reason, the current flows from the carbody through the air to the bogie, that is, a phenomenon called "carbody surge" occurs. If the carbody surge occurs, and the plate spring is electrically conductive or foreign matters such as iron powder are stuck onto a surface of the place spring, the current easily flows through the plate spring. When the current repeatedly flows through the plate spring by the carbody surge, cracks may be generated on the resin (matrix) of the plate spring by thermal stress, and the matrix of the plate spring may cause thermal decomposition by micro discharge to cause the generation of a carbonized path (track).

The fiber-reinforced resin is easily deformed by heat of around a temperature at which molding is performed. When a brake operates, the temperature of each of a wheel and a brake shoe becomes about 100 to 300° C. Therefore, the strength and stiffness of the plate spring positioned near the wheel and the brake shoe may deteriorate by heat. Further, since the plate spring is provided at a position close to a ground surface, the plate spring may be damaged by flying stones or the like.

The present invention was made in light of the above circumstances, and an object of the present invention is to provide a plate spring cover which prevents a plate spring made of fiber-reinforced resin from being damaged, and a railcar bogie including the plate spring cover.

Solution to Problem

A railcar bogie according to one aspect of the present invention includes: a cross beam supporting a carbody of a railcar; wheels provided at each of both car width direction sides of the railcar bogie so as to be lined up in a car longitudinal direction; front and rear axles each extending in a car width direction and each connecting the wheels positioned at respective left and right car width direction sides of the railcar bogie to each other, the front and rear axles being provided at respective front and rear car longitudinal direction sides of the cross beam with the cross beam interposed between the front and rear axles; bearings provided at both respective car width direction sides of each of the front and rear axles and rotatably supporting the front and rear axles; axle boxes accommodating the respective bearings; plate springs made of fiber-reinforced resin and extending in the car longitudinal direction so as to support both respective car width direction end portions of the cross beam, both car longitudinal direction end portions of each of the plate springs being supported by the respective axle boxes; electrically nonconductive buffer members each interposed between the plate spring and the axle box; electrically nonconductive contacting members each interposed between the plate spring and the cross beam; and an electrically conductive plate spring cover covering at least a part of the plate spring and electrically connected to the wheel.

According to this configuration, since the plate spring cover covers the plate spring, foreign matters such as iron powder are hardly stuck onto the surface of the plate spring. Thus, the current by the carbody surge can be prevented from flowing to the plate spring. Further, thermal stress acting on the plate spring by heat generated by the operation of the brake can be reduced. Furthermore, stones and the like can be prevented from colliding with the plate spring.

Advantageous Effects of Invention

As above, according to the present invention, the plate spring made of fiber-reinforced resin can be prevented from being damaged.

DESCRIPTION OF EMBODIMENTS

Hereinafter, a railcar bogie will be explained in reference to the drawings. In the following description and the drawings, the same reference signs are used for the same or corresponding components, and a repetition of the same explanation is avoided.

Figure 1:
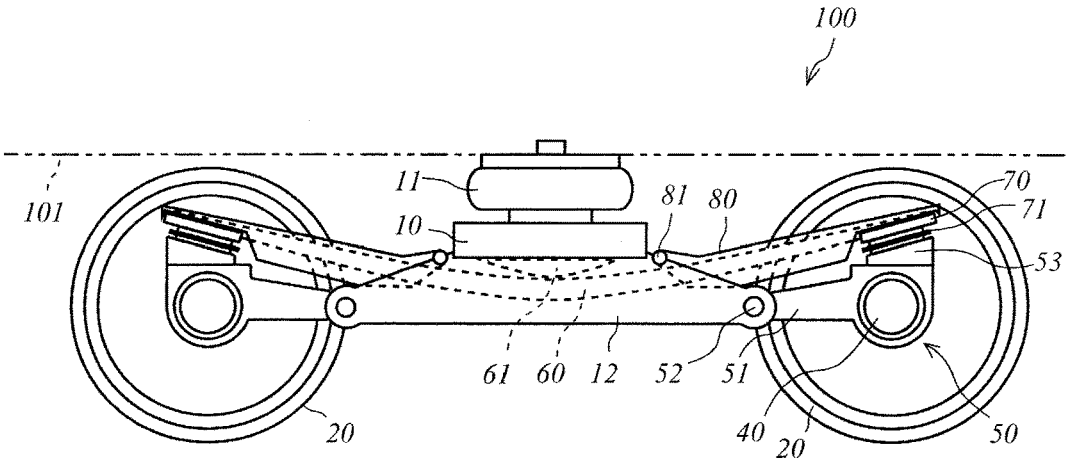
FIG. 1 is a side view of a bogie according to an embodiment.
Figure 2:
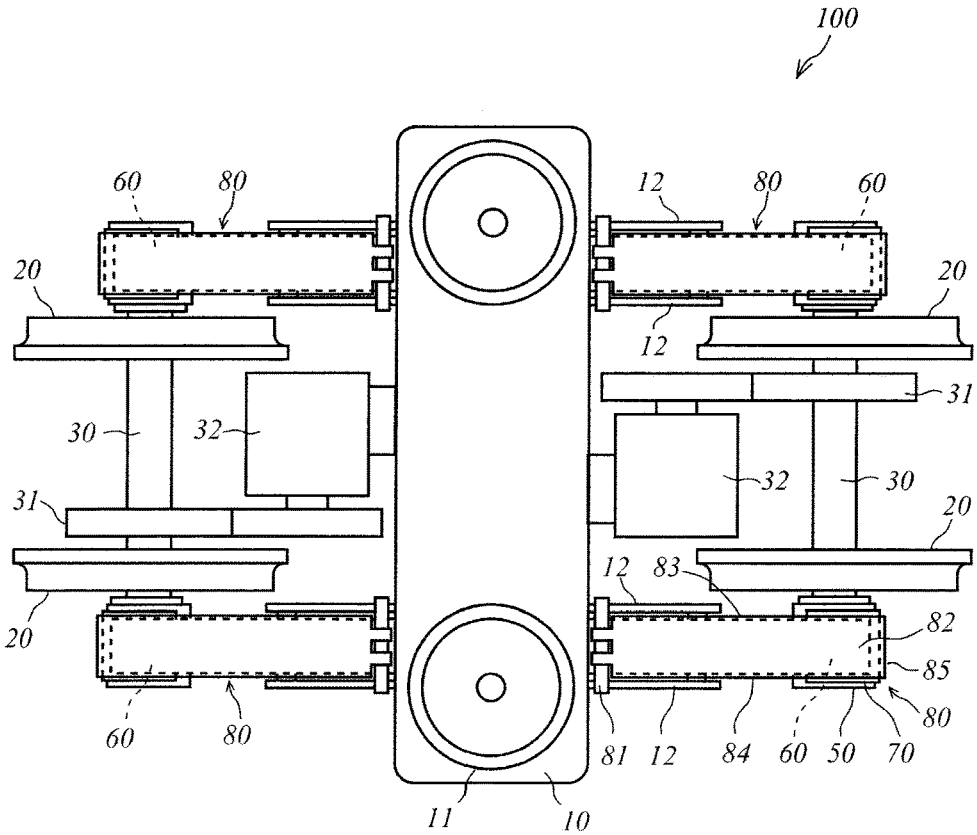
FIG. 2 is a plan view of the bogie shown in FIG. 1.

FIG. 1 is a side view of a bogie 100. FIG. 2 is a plan view of the bogie 100. A leftward/rightward direction on a paper surface of FIG. 1 corresponds to a car longitudinal direction, and a direction perpendicular to the paper surface of FIG. 1 corresponds to a car width direction. As shown in FIGS. 1 and 2, the bogie 100 includes a cross beam 10, wheels 20, axles 30, bearings 40, axle boxes 50, plate springs 60, plate spring receivers 70, and plate spring covers 80.

The cross beam 10 is a member supporting a carbody 101 of a railcar. As shown in FIG. 2, the cross beam 10 extends in the car width direction, and air springs 11 as secondary suspensions are attached onto an upper surface of the cross beam 10. The cross beam 10 supports the carbody 101 via the air springs 11. Plate-shaped receiving seats 12 are provided at each of both car width direction end portions of the cross beam 10 so as to oppose each other. Each of the plate springs 60 described below is provided so as to extend through a space between the opposing receiving seats 12.

At each of both car width direction sides of the bogie 100, the wheels 20 are provided so as to be lined up in the car longitudinal direction. The wheels 20 of the present embodiment are made of iron, and a current (return current) flowing through the wheels 20 further flows to rails 102.

Each of the axles 30 extends in the car width direction and connects the wheels 20 positioned at respective left and right car width direction sides to each other. The axles 30 are provided at respective front and rear car longitudinal direction sides of the cross beam 10 with the cross beam 10 interposed between the axles 30. A motor 32 is connected to each axle 30 through a gear box 31. When the motors 32 drive, the axles 30 rotate. Thus, the bogie 100 travels. If the bogie 100 is not a so-called electric bogie but a trailing bogie, the motors 32 and the gear boxes 31 are not provided.

Each of the bearings 40 is a member rotatably supporting the axle 30. The bearings 40 are provided at both respective car width direction sides of each axle 30 and are accommodated in the respective axle boxes 50.

Figure 3:
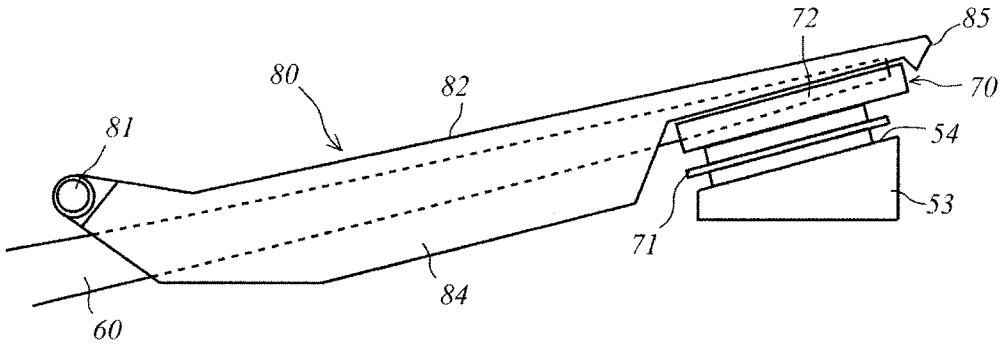
FIG. 3 is an enlarged view showing a plate spring cover shown in FIG. 1 and its vicinity.

Each of the axle boxes 50 is a member accommodating the bearing 40. The axle box 50 includes an axle beam 51 extending toward a car longitudinal direction middle portion of the bogie 100. A tip end of the axle beam 51 is positioned between the opposing receiving seats 12 and is attached to the receiving seats 12 via a shaft 52 extending in the car width direction. A plate spring seat 53 is provided on an upper surface of the axle box 50. FIG. 3 is an enlarged view showing the plate spring cover 80 and its vicinity. As shown in FIG. 3, the plate spring seat 53 includes a supporting surface 54 supporting the plate spring 60, and the supporting surface 54 is inclined in accordance with the shape of the plate spring 60 such that a portion closer to the car longitudinal direction middle portion of the bogie 100 is lower.

The plate springs 60 are members supporting the carbody 101 via the cross beam 10. Each of the plate springs 60 serves as both a conventional coil spring (primary suspension) and a conventional side sill. The plate spring 60 extends in the car longitudinal direction. The plate springs 60 support both respective car width direction end portions of the cross beam 10 via contacting members 61 each having a lower surface formed in a circular-arc shape. Each of the contacting members 61 is formed by stacking CFRP (carbon fiber-reinforced resin) and natural rubber and is electrically nonconductive. Each of both car longitudinal direction end portions of the plate spring 60 is supported by the axle box 50 via the plate spring receiver 70 and a buffer member 71.

The plate spring 60 has a bow shape that is convex downward in a side view. A car longitudinal direction middle portion of the plate spring 60 is formed to be thicker than each of both car longitudinal direction end portions of the plate spring 60. The plate springs 60 may be made of only FRP (fiber-reinforced resin) or may be made of FRP and metal. The plate spring 60 of the present embodiment has a three-layer structure constituted by an upper layer made of CFRP, a lower layer made of CFRP, and a core layer made of CFRP and GFRP (glass fiber-reinforced resin). In the present embodiment, since the plate springs 60 contain carbon fiber, the plate springs 60 are electrically conductive.

Each of the plate spring receivers 70 is a member which is located at the car longitudinal direction end portion of the plate spring 60 and receives the plate spring 60. The plate spring receiver 70 has a substantially rectangular shape in a plan view, and protective walls 72 are formed at three sides of the plate spring receiver 70, the three sides being a car width direction inner side, a car width direction outer side, and a car longitudinal direction outer side. The plate spring receiver 70 is made of metal, and a rubber sheet (not shown) is placed on a surface of the plate spring receiver 70. Further, the buffer member 71 is provided between the plate spring receiver 70 and the plate spring seat 53. The buffer member 71 is formed by stacking a layer constituted by a metal plate and a layer made of natural rubber and is electrically nonconductive. The plate spring 60 supports the carbody 101 while elastically deforming. The displacement of the plate spring 60 by the elastic deformation is absorbed by the buffer member 71.

Each of the plate spring covers 80 is a member which covers the plate spring 60 to protect the plate spring 60. The plate spring covers 80 are provided at four positions of the bogie 100 so as to cover the respective car longitudinal direction ends of the plate springs 60. The plate spring cover 80 extends in the car longitudinal direction. A base end portion of the plate spring cover 80 (i.e., a portion closer to the car longitudinal direction middle portion of the bogie 100) is positioned in the vicinity of the cross beam 10. Therefore, there is substantially no space between the cross beam 10 and the plate spring cover 80. Further, a tip end portion of the plate spring cover 80 (i.e., a car longitudinal direction end portion of the plate spring cover 80) is positioned in the vicinity of the car longitudinal direction end portion of the plate spring 60. Since the plate spring covers 80 are provided as above, the car longitudinal direction middle portions of the plate springs 60 are covered with the cross beam 10, and the other portions of the plate springs 60 are covered with the plate spring covers 80.

The base end portion of the plate spring cover 80 is attached to a rotating shaft member 81 provided at the receiving seats 12. The rotating shaft member 81 is a columnar member positioned in the vicinity of the cross beam 10 and extending in the car width direction. The plate spring cover 80 can turn around a turning axis that is a central axis of the rotating shaft member 81. According to this configuration, when the plate spring 60 deforms, the plate spring cover 80 turns in accordance with the deformation of the plate spring 60. Therefore, the plate spring cover 80 can always cover the plate spring 60. The rotating shaft member 81 may be directly provided at the cross beam 10 instead of the receiving seats 12. In the present embodiment, the rotating shaft member 81 is included. However, the plate spring cover 80 may be configured so as not to turn. In such a case, the plate spring cover 80 may be attached to the plate spring 60 with a predetermined clearance secured between the plate spring cover 80 and the plate spring 60 in consideration of a deformation amount of the plate spring 60.

The plate spring cover 80 is made of metal and is electrically conductive. However, the plate spring cover 80 may be made of resin in a case where an electrically conductive material such as aluminum foil is stuck onto a surface of the plate spring cover 80. To be specific, if the plate spring cover 80 is electrically conductive as a whole, a material of the plate spring cover 80 is not especially limited.

The plate spring cover 80 includes: an upper surface portion 82 covering an upper surface of the plate spring 60; an inner surface portion 83 covering a car width direction inner surface of the plate spring 60; an outer surface portion 84 covering a car width direction outer surface of the plate spring 60; and an end surface portion 85 covering a car longitudinal direction end surface of the plate spring 60. The inner surface portion 83 and the outer surface portion 84 are plane-symmetric to each other. To prevent the inner surface portion 83 and the outer surface portion 84 from interfering with the plate spring receiver 70 and the buffer member 71, each of the inner surface portion 83 and the outer surface portion 84 is formed such that a vertical size of each of the inner surface portion 83 and the outer surface portion 84 in the vicinity of the tip end of the plate spring cover 80 is smaller than a vertical size of each of the inner surface portion 83 and the outer surface portion 84 in the vicinity of the base end of the plate spring cover 80. The end surface portion 85 extends obliquely downward from a tip end of the upper surface portion 82 toward the car longitudinal direction middle portion of the bogie 100. To be specific, the end surface portion 85 does not extend in a direction perpendicular to the upper surface portion 82 but extends so as to be inclined relative to this direction toward the base end side of the plate spring cover 80. Although not shown, if the end surface portion 85 is configured so as to be engaged with the plate spring 60, the plate spring receiver 70, or the buffer member 71, the turning of the plate spring cover 80 is restricted. Thus, the plate spring cover 80 can be prevented from excessively turning and getting away from the plate spring 60.

Figure 4:
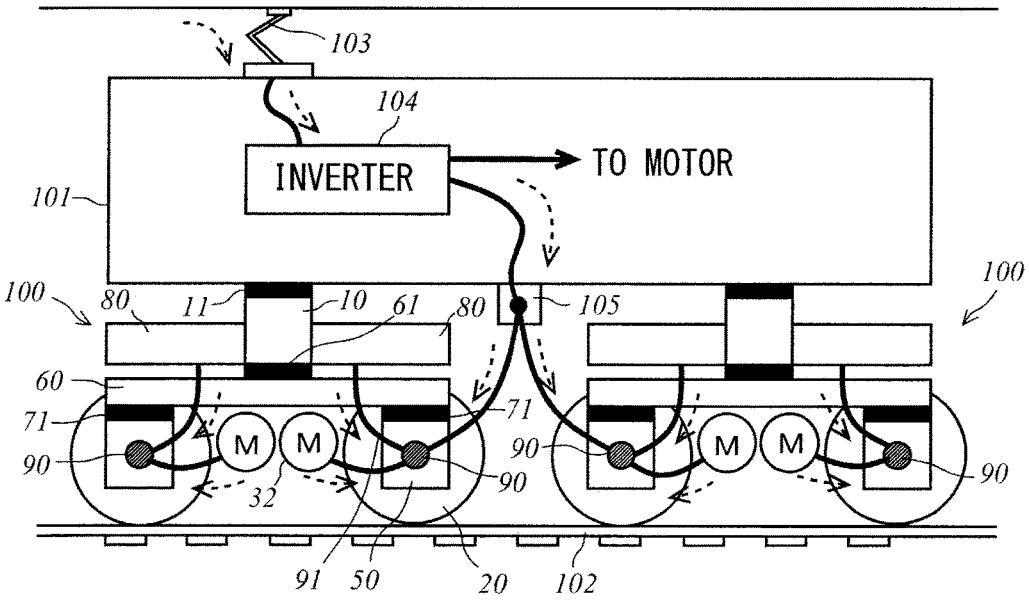
FIG. 4 is a schematic diagram of an electric system of the bogie shown in FIG. 1.

Next, an electric system of the bogie 100 will be explained in reference to FIG. 4. FIG. 4 is a schematic diagram showing the electric system of the bogie 100 and an electric system of the carbody 101 according to the present embodiment. As shown in FIG. 4, the bogie 100 includes grounding devices 90 each positioned in the vicinity of the axle 30. The grounding devices 90 are devices which allow the current from the carbody 101 to flow through the axles 30 and the wheels 20 to the rails 102. The configuration of the grounding device 90 is not especially limited and may be such that a ground brush contacts a surface of the axle 30 or an end surface of the axle 30. The current from a pantograph 103 flows through an inverter 104 and a ground terminal block 105 to the grounding device 90. The current from the inverter 104 flows to the motor 32 of the bogie 100 and further flows to the grounding device 90.

In the present embodiment, the grounding device 90 and the plate spring cover 80 are electrically connected to each other through an electric wire 91. To be specific, the plate spring cover 80 is electrically connected to the axle 30 and the wheel 20. According to this configuration, even if the current is about to flow from the carbody 101 to the plate spring 60 by the carbody surge, the current does not reach the plate spring 60 but flows to the plate spring cover 80. Then, the current further flows from the plate spring cover 80 through the grounding device 90 to the wheel 20. Since the plate spring 60 contacts the cross beam 10 via the electrically nonconductive contacting member 61 and contacts the axle box 50 via the electrically nonconductive buffer member 71, the plate spring 60 is electrically insulated from the other members in the bogie 100. Therefore, even if the current flows to the other members in the bogie 100, the current does not flow to the plate spring 60. Since the plate spring cover 80 covers the plate spring 60, the foreign matters such as the iron powder are hardly stuck onto the surface of the plate spring 60. Therefore, the current can be further prevented from flowing to the plate spring 60. As above, according to the present embodiment, the current flowing to the bogie 100 by the carbody surge bypasses the plate spring 60 and flows through the axle 30, the wheel 20, and the rail 102 in order. Therefore, the plate spring 60 can be prevented from being damaged by the carbody surge.

In the present embodiment, since the plate spring cover 80 covers the plate spring 60, influences on the plate spring 60 by heat generated at the wheels and the brake shoes at the time of braking can be prevented, and the plate spring 60 can be protected from physical impacts such as collision of stones.

As above, the bogie 100 according to the present embodiment includes: a cross beam 10 supporting a carbody 101 of a railcar; wheels 20 provided at each of both car width direction sides of the bogie 100 so as to be lined up in a car longitudinal direction; front and rear axles 30 each extending in a car width direction and each connecting the wheels 20 positioned at respective left and right car width direction sides of the bogie 100 to each other, the front and rear axles 30 being provided at respective front and rear car longitudinal direction sides of the cross beam 10 with the cross beam 10 interposed between the front and rear axles 30; bearings 40 provided at both respective car width direction sides of each of the front and rear axles 30 and rotatably supporting the front and rear axles 30; axle boxes 50 accommodating the respective bearings 40; plate springs 60 made of fiber-reinforced resin and extending in the car longitudinal direction so as to support both respective car width direction end portions of the cross beam 10, both car longitudinal direction end portions of each of the plate springs 60 being supported by the respective axle boxes 50; electrically nonconductive buffer members 71 each interposed between the plate spring 60 and the axle box 50; electrically nonconductive contacting members 61 each interposed between the plate spring 60 and the cross beam 10; and an electrically conductive plate spring cover 80 covering at least a part of the plate spring 60 and electrically connected to the wheel 20.

As above, since the bogie 100 according to the present embodiment includes the plate spring cover 80 covering the plate spring 60, the foreign matters are hardly stuck onto the surface of the plate spring 60. Therefore, the current by the carbody surge can be prevented from flowing to the plate spring 60. Further, since the plate spring 60 is electrically insulated from the other members in the bogie 100, the current hardly flows through the plate spring 60. In addition, even if the current is about to flow to the plate spring 60, the current flows from the plate spring cover 80 covering the plate spring 60 to the wheel 20. Therefore, the current can be prevented from flowing to the plate spring 60. Further, influences on the plate spring 60 by the heat generated by the operation of the brake can be reduced. Furthermore, stones and the like can be prevented from colliding with the plate spring 60. Therefore, according to the present embodiment, the plate spring 60 can be prevented from being damaged.

Each of the plate spring covers 80 of the present embodiment is attached to the cross beam 10 or a member (the receiving seat 12) positioned near the cross beam 10 and extends from the cross beam 10 to a car longitudinal direction end portion of the plate spring 60. Therefore, the car longitudinal direction middle portion of the plate spring 60 can be covered with the cross beam 10, and the other portion of the plate spring 60 can be covered with the plate spring covers 80. To be specific, the entire plate spring 60 can be covered with the cross beam 10 and the plate spring covers 80.

The plate spring cover 80 of the present embodiment is rotatably attached to the cross beam 10 or the member (the receiving seat 12) positioned near the cross beam 10 through a rotating shaft member 81 extending in the car width direction. Therefore, even when the plate spring 60 deforms, the plate spring cover 80 can turn in accordance with the deformation of the plate spring 60. Thus, the plate spring cover 80 can always cover the plate spring 60.

The plate spring cover 80 of the present embodiment includes at least an end surface portion 85 covering a car longitudinal direction end surface of the plate spring 60, and the end surface portion 85 is engaged with the plate spring 60 or a member (the plate spring receiver 70 and the buffer member 71) supporting the plate spring 60. According to this configuration, the plate spring cover 80 can be prevented from excessively turning.

The foregoing has explained the embodiments of the present invention in reference to the drawings. However, specific configurations are not limited to these embodiments. Design changes and the like within the scope of the present invention are included in the present invention.

INDUSTRIAL APPLICABILITY

Since the bogie according to the present invention can prevent the plate spring made of fiber-reinforced resin from being damaged, the bogie according to the present invention is useful in a technical field of railcars.

REFERENCE SIGNS LIST

10 cross beam
20 wheel
30 axle
40 bearing
50 axle box
60 plate spring
61 contacting member
70 plate spring receiver
71 buffer member
80 plate spring cover
81 rotating shaft member
85 end surface portion
100 bogie
101 carbody

The invention claimed is:

1. A railcar bogie comprising:

a cross beam supporting a carbody of a railcar;

wheels provided at each of both car width direction sides of the railcar bogie so as to be lined up in a car longitudinal direction;

front and rear axles each extending in a car width direction and each connecting the wheels positioned at respective left and right car width direction sides of the railcar bogie to each other, the front and rear axles being provided at respective front and rear car longitudinal direction sides of the cross beam with the cross beam interposed between the front and rear axles;

bearings provided at both respective car width direction sides of each of the front and rear axles and rotatably supporting the front and rear axles;

axle boxes accommodating the respective bearings;

plate springs made of fiber-reinforced resin and extending in the car longitudinal direction so as to support both respective car width direction end portions of the cross beam, both car longitudinal direction end portions of each of the plate springs being supported by the respective axle boxes;

electrically nonconductive buffer members each interposed between the plate spring and the axle box;

electrically nonconductive contacting members each interposed between the plate spring and the cross beam; and an electrically conductive plate spring cover covering at least a part of the plate spring and electrically connected to the wheel.

2. The railcar bogie according to claim 1, wherein the plate spring cover is attached to the cross beam or a member positioned near the cross beam and extends from the cross beam to a car longitudinal direction end portion of the plate spring.

3. The railcar bogie according to claim 2, wherein the plate spring cover is rotatably attached to the cross beam or the member positioned near the cross beam through a rotating shaft member extending in the car width direction.

4. The railcar bogie according to claim 3, wherein:

the plate spring cover includes at least an end surface portion covering a car longitudinal direction end surface of the plate spring; and the end surface portion is engaged with the plate spring or a member supporting the plate spring.

5. An electrically conductive plate spring cover applicable to a railcar bogie, the railcar bogie including a cross beam supporting a carbody of a railcar, wheels provided at each of both car width direction sides of the railcar bogie so as to be lined up in a car longitudinal direction, front and rear axles each extending in a car width direction and each connecting the wheels positioned at respective left and right car width direction sides of the railcar bogie to each other, the front and rear axles being provided at respective front and rear car longitudinal direction sides of the cross beam with the cross beam interposed between the front and rear axles, bearings provided at both respective car width direction sides of each of the front and rear axles and rotatably supporting the front and rear axles, axle boxes accommodating the respective bearings, plate springs made of fiber-reinforced resin and extending in the car longitudinal direction so as to support both respective car width direction end portions of the cross beam, both car longitudinal direction end portions of each of the plate springs being supported by the respective axle boxes, electrically nonconductive buffer members each interposed between the plate spring and the axle box, and electrically nonconductive contacting members each interposed between the plate spring and the cross beam, the electrically conductive plate spring cover comprising:

one end attached to the cross beam or the cross beam through a receiving seat; and the other end engaged with the plate spring or a member supporting the plate spring, the electrically conductive plate spring cover being electrically connected to the wheel.

* * * * *